US009162733B2

(12) United States Patent
Donahue et al.

(10) Patent No.: US 9,162,733 B2
(45) Date of Patent: Oct. 20, 2015

(54) MARINE AFT BULKHEAD AND WINDOW SYSTEM

(71) Applicant: The Talaria Company, Portsmouth, RI (US)

(72) Inventors: John Donahue, Tiverton, RI (US); Keith S. Attee, Chalevoix, MI (US); Thomas H. Buerkle, Kewadin, MI (US); David L. Draper, Charlevoix, MI (US)

(73) Assignee: The Talaria Company, Portsmouth, RI (US)

( * ) Notice: Subject to any disclaimer, the term of this patent is extended or adjusted under 35 U.S.C. 154(b) by 0 days.

(21) Appl. No.: 14/269,244

(22) Filed: May 5, 2014

(65) Prior Publication Data

US 2014/0331907 A1 Nov. 13, 2014

Related U.S. Application Data

(60) Provisional application No. 61/820,206, filed on May 7, 2013.

(51) Int. Cl.
*B63B 19/00* (2006.01)

(52) U.S. Cl.
CPC ..... *B63B 19/00* (2013.01); *B63B 2019/0046* (2013.01)

(58) Field of Classification Search
CPC .... E05Y 2900/514; B63B 29/02; B63B 19/00
See application file for complete search history.

(56) References Cited

U.S. PATENT DOCUMENTS

| | | | | |
|---|---|---|---|---|
| 5,640,924 | A * | 6/1997 | Murrant | 114/361 |
| 2007/0186839 | A1 * | 8/2007 | Mercier et al. | 114/361 |

* cited by examiner

*Primary Examiner* — Edwin Swinehart
(74) *Attorney, Agent, or Firm* — Chapin IP Law, LLC

(57) ABSTRACT

A marine aft bulkhead and window system in a fully framed assembly includes a port side glass assembly that is fully retractable below a lowest edge of a window opening, a starboard side glass assembly that is fully retractable below the lowest edge of the window opening, a door glass assembly that is fully retractable below the lowest edge of a door opening, and a door assembly that is fully retractable to port or starboard horizontally.

10 Claims, 7 Drawing Sheets

MARINE AFT BULKHEAD AND WINDOW SYSTEM

CROSS REFERENCE TO RELATED APPLICATIONS

This application claims the benefit of U.S. Provisional Application No. 61/820,206, filed May 7, 2013. The disclosure of the prior application is considered part of and is incorporated by reference in the disclosure of this application.

BACKGROUND OF THE INVENTION

The present invention relates to marine craft, and more particularly to a marine aft bulkhead and window system.

In general, a pilot house is an area on a ship housing the steering controls, with shelter and room for at least one member of the crew who can control the ship while it is in motion. On small crafts, the pilot house is usually limited in size and has few amenities. On larger boats, it is typically part of a larger bridge, housing multiple personnel and equipment like radar, radio, storage cabinets for charts, and so forth.

In addition to the wheel or other steering mechanism, the structure may have other tools for navigation, including electronic charts, radar to identify hazards, and communications radios. There may be a chair for comfort. Fixed or opening glass or fixed heavy duty plastic encloses three sides of the structure to provide an unimpeded view of the surrounding area while keeping the weather out.

The pilot house is built as an integral part of the design of the boat from the start. A cockpit canvas cover is often an "after the build" tack to provide an aft barrier to the area sheltered by the pilot house. However, these non-permanent covers are vulnerable during inclement weather and maintenance intensive. In addition, most aft cockpit canvas covers are inefficient and not well integrated.

SUMMARY OF THE INVENTION

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

The present invention provides a marine aft bulkhead and window system.

In general, in one aspect, the invention features a marine aft bulkhead and window system in a fully framed assembly including a port side glass assembly that is fully retractable below a lowest edge of a window opening, a starboard side glass assembly that is fully retractable below the lowest edge of the window opening, a door glass assembly that is fully retractable below the lowest edge of a door opening, and a door assembly that is fully retractable to port or starboard horizontally.

Implementations may include, and are not limited to, one or more of the following features.

When the port, starboard and door glass assemblies are fully retracted, there are no vertical glass channels or mullions remaining. The opening from port to starboard pilot house sides is open without structural restrictions. The door may slide on a track to a concealed storage location of the port or starboard fixed wall.

The marine aft bulkhead and window system may include a below floor storage well to receive the port side glass assembly, the starboard side glass assembly and the door assembly when fully retracted.

The port side glass assembly and the starboard side glass assembly can move in a vertical plane where an outer edge of a glass portion has a fixed channel attached.

The port side glass assembly and the starboard side glass assembly can each include a glass portion and a lift system, out of sight to port or starboard. The glass portion may bonded to a channel on the outboard side that engages the lift system and the glass is guided vertically by a U channel below the beltline adjacent to the door opening.

The mullions may further include a seal on their outer edge that engages a forward side of a glass portion of the port side glass assembly and a forward side of a glass portion of starboard side glass assembly when in a raised position.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

The invention will be more fully understood by reference to the detailed description, in conjunction with the following figures, wherein.

DETAILED DESCRIPTION

Figure 1:
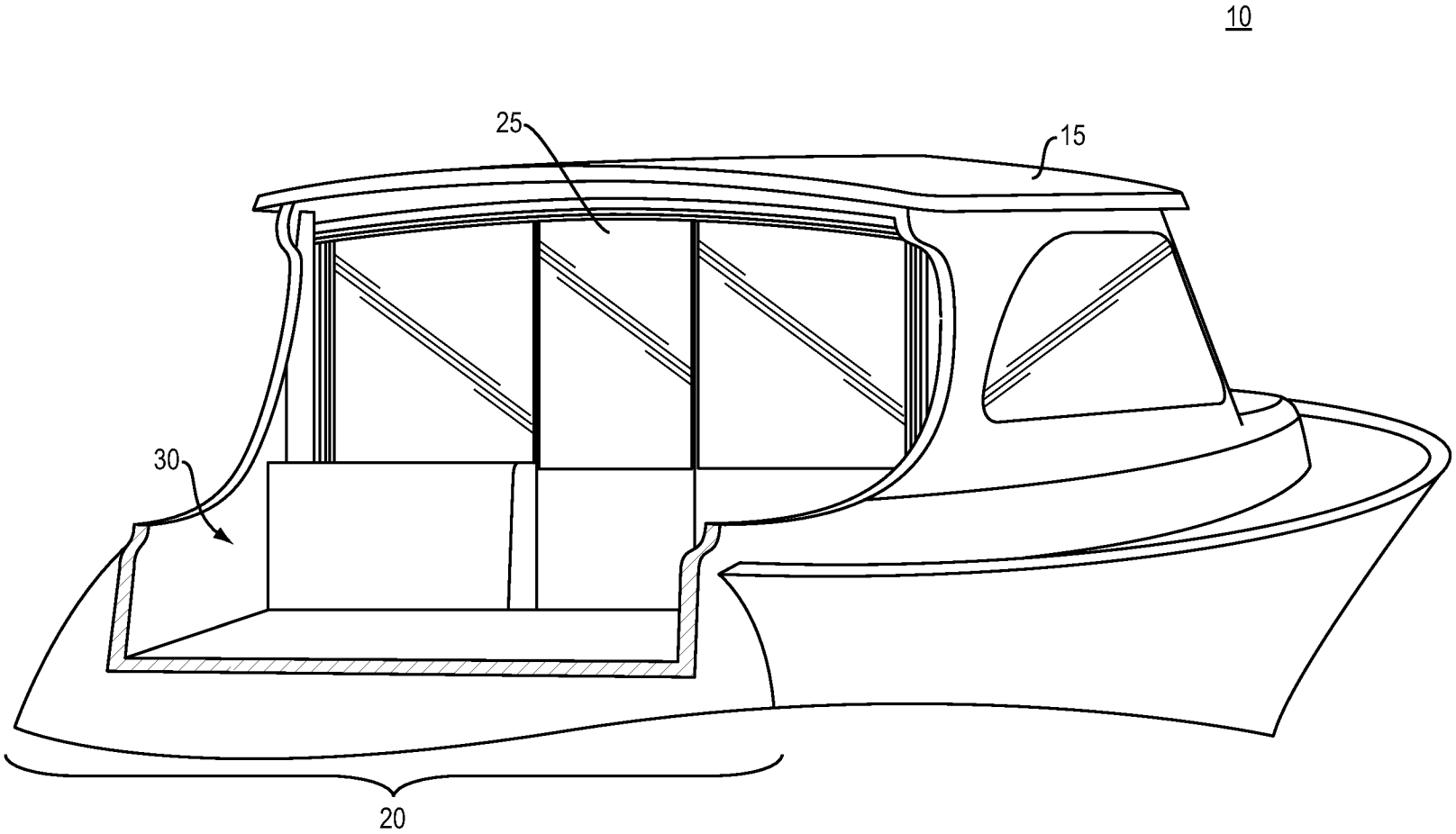
FIG. 1 is a cutaway diagram of an exemplary marine craft including an exemplary aft bulkhead and window system of the present invention.

The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

The term "or" is intended to mean an inclusive "or" rather than an exclusive "or." That is, unless specified otherwise, or clear from context, "X employs A or B" is intended to mean any of the natural inclusive permutations. That is, if X employs A, X employs B, or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

As shown in FIG. 1, a cutaway of an exemplary marine craft 10 includes a pilot house 15 and an open aft region 20. An aft portion of the pilot house 15 includes an aft bulkhead and window system 25, fully described below, which separates the pilot house 15 and the aft region 20. The aft region 20 includes a deck 30. The aft bulkhead and window system 25 provides a wall and door system where multiple windows and a passageway door disappear from view when fully opened, giving the appearance and function of an open pilot house marine cruiser but the practicality of a closed pilot house yacht when the multiple windows and passageway door are closed, i.e., in an up or raised position. More specifically, the multiple windows slid up and down and are concealed in a solid structure, such as a solid wall or cabinet, separating the pilot house 15 and the aft region 20 when open and the passageway door slides down and laterally, either to port or starboard, into the solid structure when open. In a preferred embodiment, the multiple windows and passageway door are a clear glass, either tempered or non-tempered.

Figure 2:
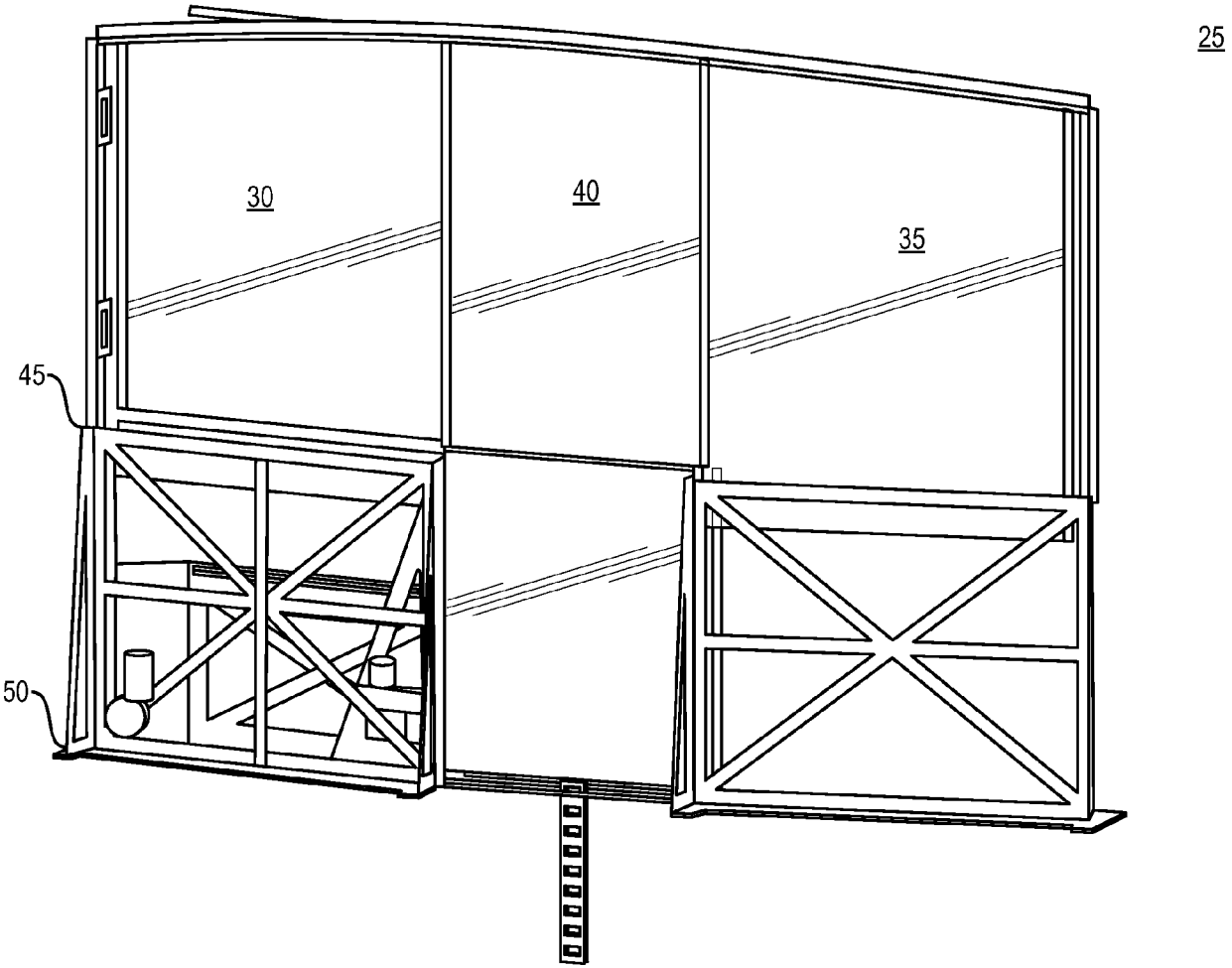
FIG. 2 is a diagram of the exemplary aft bulkhead and window system of the present invention.

As shown in FIG. 2, in one embodiment, the aft bulkhead and window system 25 is a fully framed assembly that includes three major components, i.e., a port side glass assembly 30, a starboard side glass assembly 35 and a door assembly 40. The three components 30, 35 and 40 enable full retraction of one or both of the glass assemblies 30, 35, and the door assembly 40, so they completely disappear below a lowest edge of a window opening, referred to as a beltline 45. A vertical height of the windows 30, 35 determines a vertical space necessary to retract them. When a window vertical height dimension is higher than a dimension from the sole (i.e., floor) 50, a below floor storage well (i.e., trough) is required to fully retract the windows 30, 35 and door 40.

Figure 3:
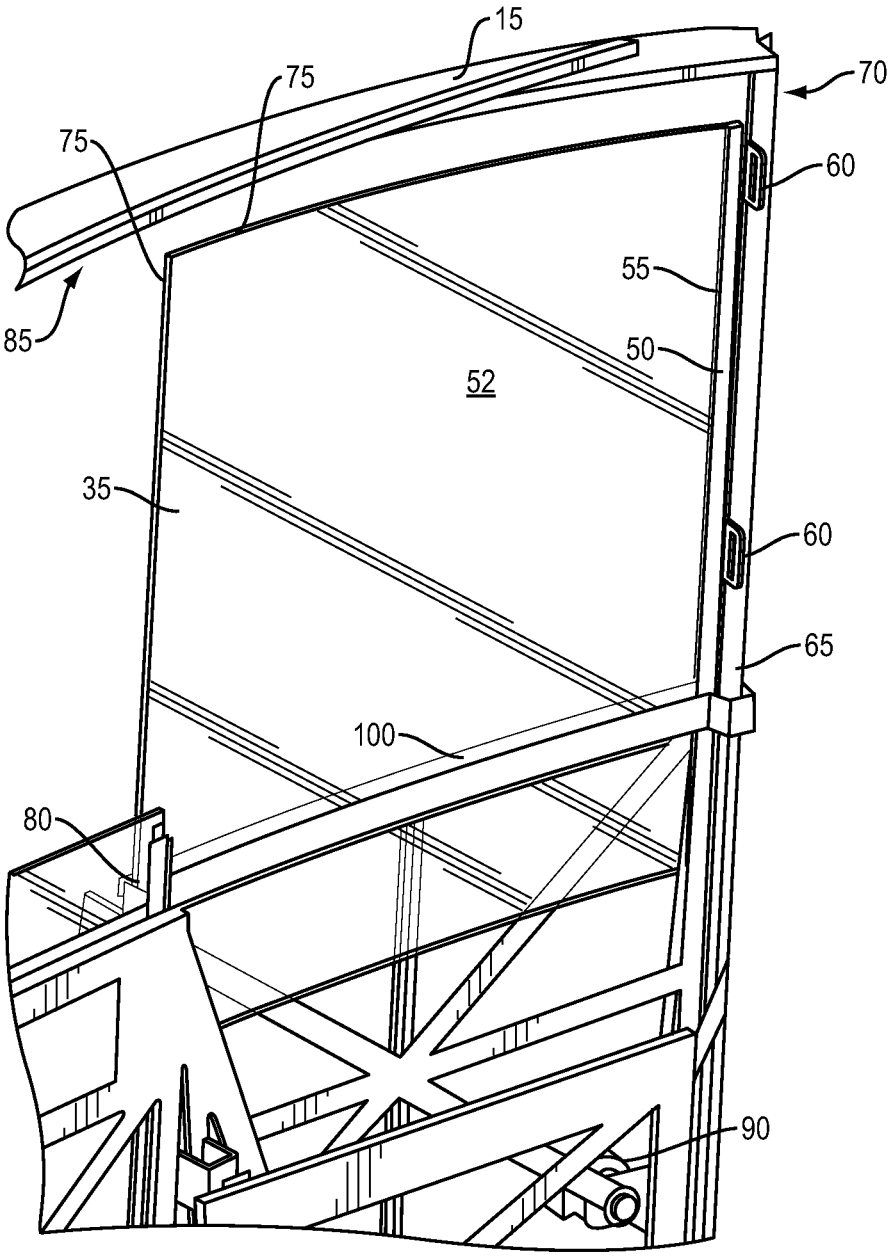
FIG. 3 is a diagram of an exemplary side glass assembly of the aft bulkhead and window system of the present invention.

As shown in FIG. 3, each port side glass assembly 30 and starboard side glass assembly 35, starboard glass assembly 35 for example, moves in a vertical plane where an outer edge 50 of the glass 52 has a fixed channel 55 attached. Ball bearing travelers (or cars) 60 are attached to the channel 55 at fixed intervals and ride on a fixed vertical track 65 that is part of a larger bulkhead 70 that is in turn tied to an outer wall (not shown) of the pilot house 15. An exposed inboard side 75 of the glass, in an up position, has no frame or track attached to it. As the glass retracts the outer edge 50 remains guided by the travelers 60 and fixed vertical track 65 while an inner edge 80, adjacent to the door assembly 40, is guided by a channel (not shown) below the beltline 45. When the glass assembly 30 is fully up in a raised position, it engages an upper horizontal track 85 at the top of the glass. The upper horizontal track 85 may have a sweep or arc in it when viewed perpendicular to the surface of the glass assembly 40, which compliments a mating roof shape of the pilot house 15.

The glass of the glass assembly 30 is raised and lowered using a line drive system 90 acting on a lift bracket 95 attached to a lower edge 100 of the glass, out of sight below the beltline 45. A continuous line spools on an off a drive wheel powered by an electric motor and gearbox. From the line's attachment at the upper traveler 60, the line passes up through a pulley attached at the upper horizontal track 85 and back down to the drive wheel where it spools on to the drive wheel lifting the glass window. The line travels back to a lower pulley attached near the bottom of the track 65. This makes a continuous drive line loop.

The glass 52 slides vertically through a horizontally positioned seal 100 attached to the beltline 45, i.e., the lower edge of the window opening. The seal 100 is flexible so that once the glass 52 is lowered below the beltline 45 the seal 100 covers an opening the glass 52 passes through.

Figure 4:
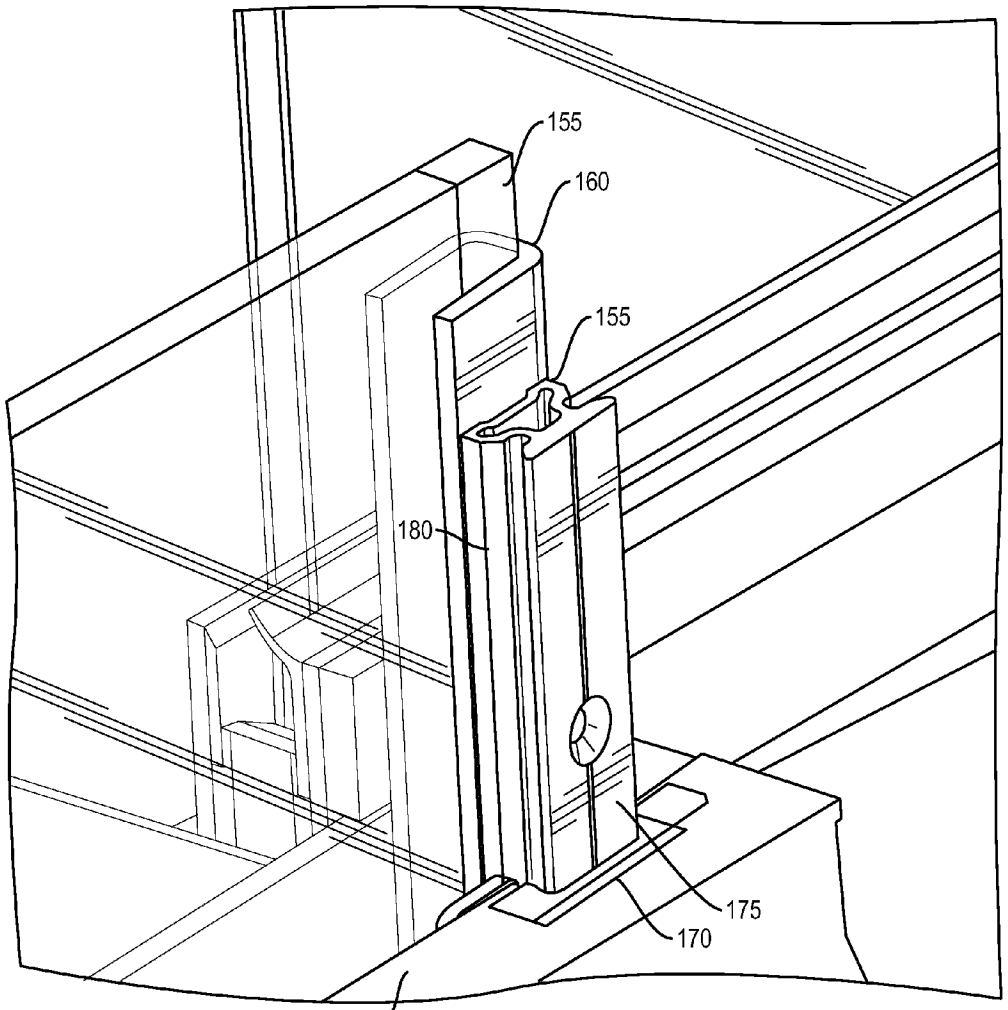
FIG. 4 is a diagram of an exemplary door assembly of the aft bulkhead and window system of the present invention.

As shown in FIG. 4, the glass of the door assembly 40 retracts vertically into a door lower section 150 and projects through the bottom of the door. The glass is bonded to two mullions 155 that run vertically on each side of the glass. The mullions include a U channel 160 and a track 165. The mullions 155 move on travelers 170 that are affixed left and right to the door frame 175. This enables the mullions 155 to carry the glass up or down relative to the door frame 175 so they disappear when the glass is fully retracted. The mullions 155 incorporate a seal 180 on their outer edge that engages the forward side of the port and starboard side glass panels when in a raised position.

The glass of the door assembly 40 is raised and lowered using a line drive lift system as described above. In this application, there is no lower channel into which the glass slides as there is on the retracting side glass assemblies 30, 35. The affixed mullions 155 carry the glass to its lowered position on the travelers 170 attached to each side of the door frame 175. When fully retracted, the glass passes through the bottom of the door frame into the storage well (not shown). A stinger 185 (in FIG. 2) attached to the door frame extends below the lower edge of the door to position the lowest pulley on the driveline system. The upper pulley attaches to the door frame at the beltline. The stinger 185 moves with the door as the door slides.

Figure 5:
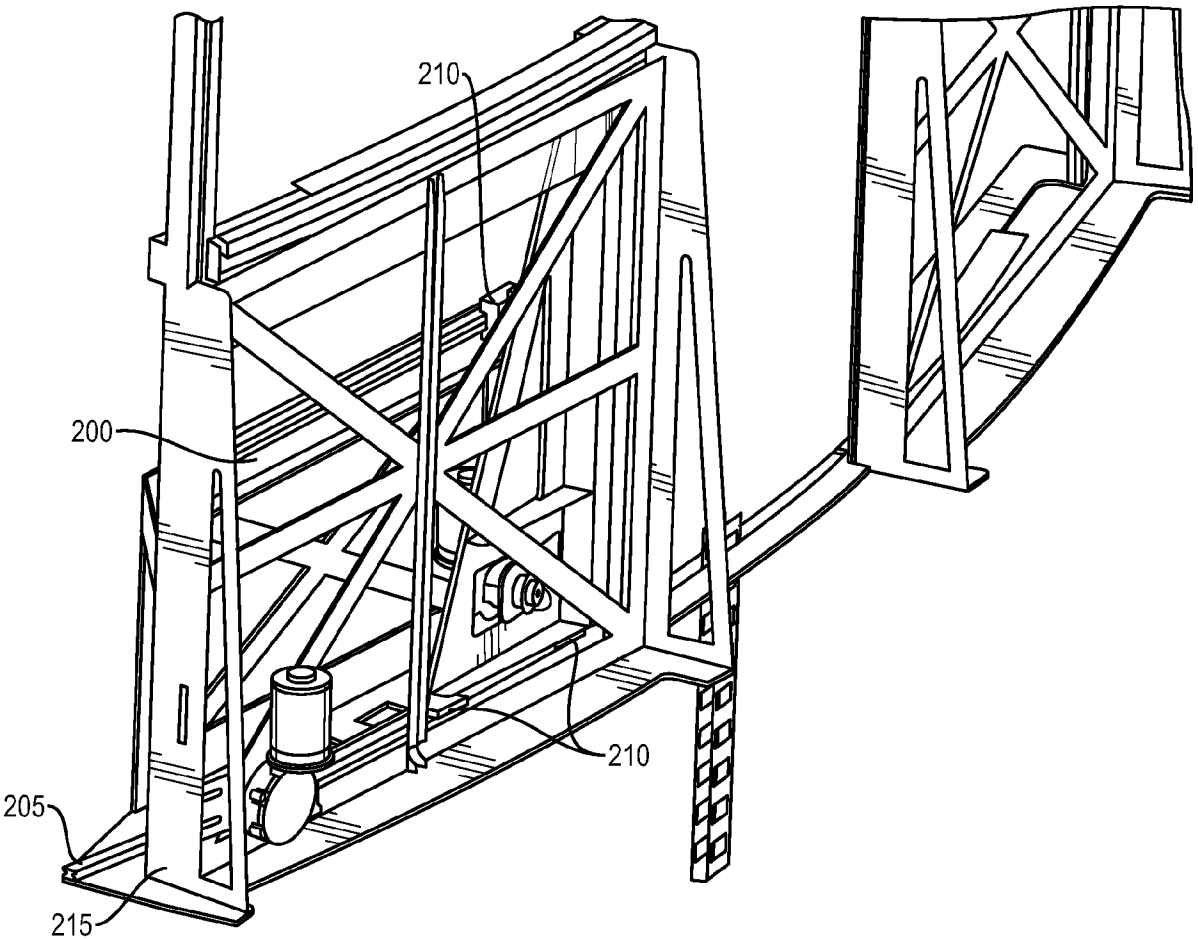
FIG. 5 is a diagram of the door assembly of the aft bulkhead and window system of the present invention.
Figure 6:
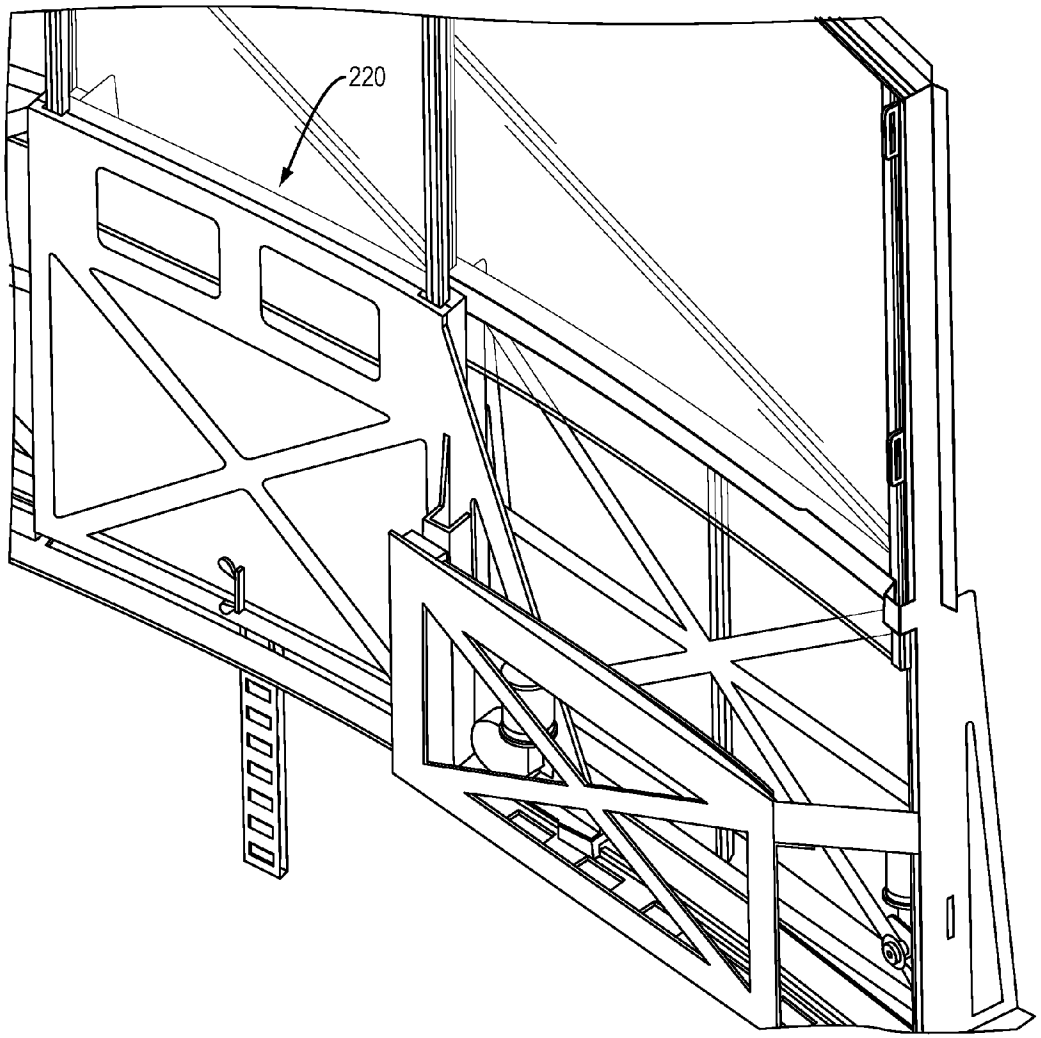
FIG. 6 is a diagram of the door assembly of the aft bulkhead and window system of the present invention.
Figure 7:
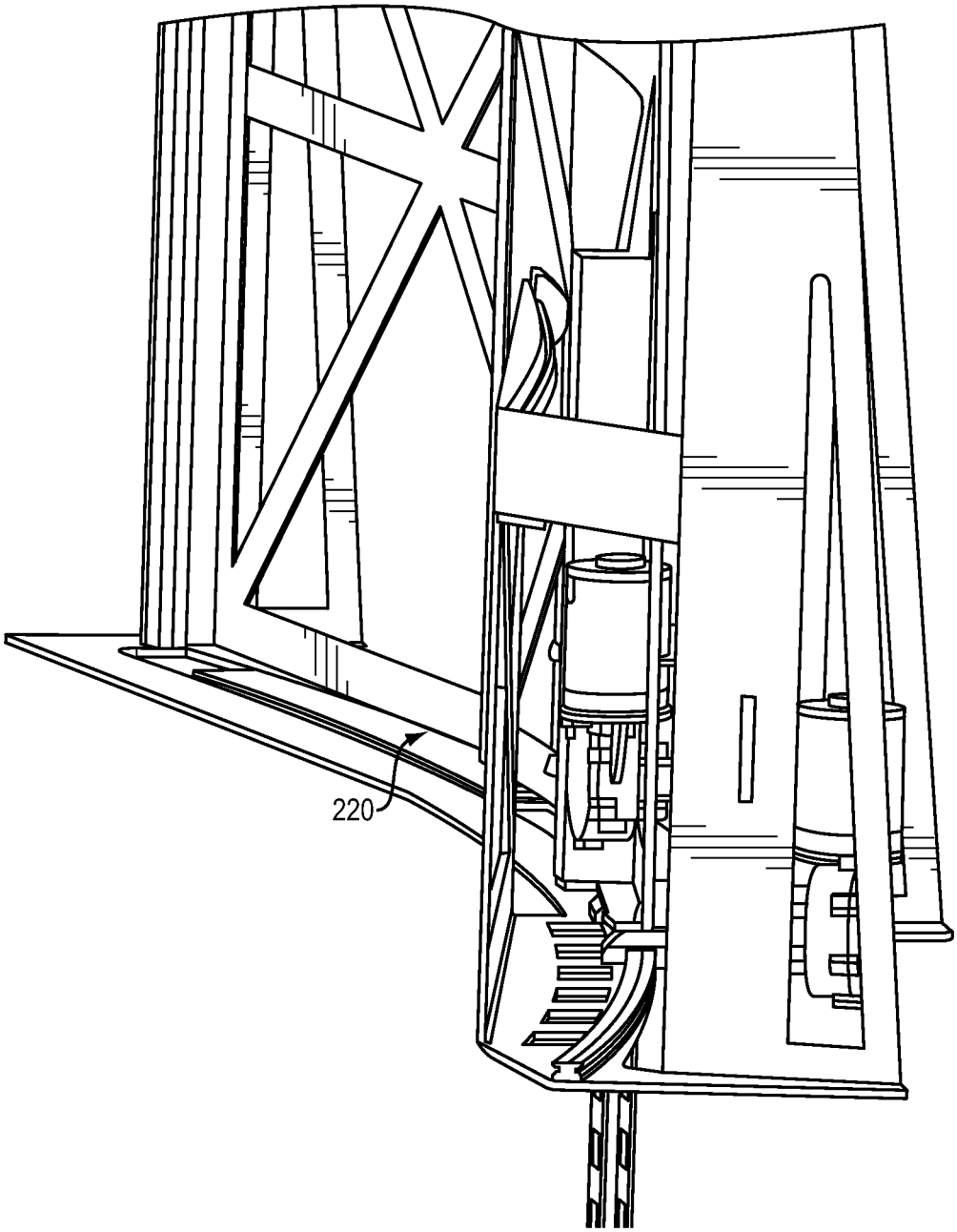
FIG. 7 is a diagram of the door assembly of the aft bulkhead and window system of the present invention.

As shown in FIG. 5 and FIG. 6, the door assembly 40, in a lowered or down position, moves horizontally to either the port or starboard side, as packaging allows, providing an open doorway between the pilot house 15 and the aft region 20. An upper horizontal track 200 and a lower horizontal track 205 are affixed to a lower wall below the respective vertical window 30, 35. The door assembly 40 slides into the wall by travelers 210 attached to the door frame 215, one approximately mid-door, the other at floor height. Tracks in the door frame 215 position the door forward of the side windows 30, 35 so the door slides into a wall or cabinet inside the pilot house 15. Both the door and door glass seal against the corresponding side glass 30, 35 and a door jamb. On the opposite side, the seal is a wiper seal located on the outboard side of the door. As shown in FIG. 7, the upper edge of the door glass, when raised, slots into a seal channel 220 above the door and forward of the upper side glass channel, on the side the door sides. This enables the door to open with the glass up or down by passing ahead of the slide glass.

There is a wider opening in the beltline on the side the door slides so that both the vertical retracting glass and the door glass pass through the same opening. A wider flexible seal closes off the opening from both the aft and forward sides. Water will pass by the seal in limited amounts and is collected in the storage well trough below the sole and is then drained overboard or into the bilge.

Affixed to the latching side of the door is a threshold plate. When the door is opened, it slides over the slot in the sole to close off the opening. In turn, it retracts and hides in the opposite wall as the door is closed.

A latch and lock mechanism is affixed to the door jamb below the beltline on the opposite wall from where the door retracts.

As described above, the present invention provides a wall and door system where both the windows and passageway door disappear from view when fully opened, giving the appearance and function of an open pilot house express cruiser but the practicality of a closed pilot house motor yacht. The present invention permits the operation of the aft bulkhead wall in any combination of openings, i.e., fully closed, door window open or closed, port and starboard glass independently, open or closed. Additionally, the mullion sizes are minimal leaving a more open visual feeling when the door glass is in the up position.

The present invention offers flexibility to produce the aft bulkhead as a flat wall or swept to a constant radius. It may include a doorway or doorways in one, two or more side glass panels. The vertical glass dimensions may enable packaging without going below the sole for storage. All of the materials are corrosion resistant, e.g., stainless steel, plastic or composites for superior performance in a marine environment.

Other embodiments are within the scope and spirit of the invention. Features implementing functions may be physically located at various positions, including being distributed such that portions of functions are implemented at different physical locations.

While the above describes a particular order of operations performed by certain embodiments of the invention, it should be understood that such order is exemplary, as alternative embodiments may perform the operations in a different order, combine certain operations, overlap certain operations, or the like. References in the specification to a given embodiment indicate that the embodiment described may include a particular feature, structure, or characteristic, but every embodiment may not necessarily include the particular feature, structure, or characteristic.

The foregoing description does not represent an exhaustive list of all possible implementations consistent with this disclosure or of all possible variations of the implementations described. A number of implementations have been described. Nevertheless, it will be understood that various modifications may be made without departing from the spirit and scope of the systems, devices, methods and techniques described here. Accordingly, other implementations are within the scope of the following claims.

What is claimed is:

1. A marine aft bulkhead and window system in a fully framed assembly comprising:

a port side glass assembly that is fully retractable below a lowest edge of a window opening;

a starboard side glass assembly that is fully retractable below the lowest edge of the window opening;

a door glass assembly that is fully retractable below the lowest edge of a door opening; and a door assembly that is fully retractable to port or starboard horizontally.

2. The marine aft bulkhead and window system of claim 1 further comprising a below floor storage well to receive the port side glass assembly, the starboard side glass assembly and the a door assembly when fully retracted.

3. The marine aft bulkhead and window system of claim 1 wherein the port side glass assembly moves in a vertical plane where an outer edge of a glass portion has a fixed channel attached.

4. The marine aft bulkhead and window system of claim 1 wherein the starboard side glass assembly moves in a vertical plane where an outer edge of a glass portion has a fixed channel attached.

5. The marine aft bulkhead and window system of claim 1 wherein the port side glass assembly comprises:

a glass portion; and a drive system acting on a fixed channel attached an edge of the glass portion, out of sight to port or starboard.

6. The marine aft bulkhead and window system of claim 1 wherein the starboard side glass assembly comprises:

a glass portion; and a drive system acting on a lift bracket attached to a lower edge of the glass portion, out of sight below a beltline.

7. The marine aft bulkhead and window system of claim 1 wherein the door assembly comprises:

a glass portion;

a drive system acting on a lift bracket attached to a lower edge of the glass portion, out of sight below a beltline; and a horizontal sliding track system that enables the door to open and close on tracks mounted to a base of the bulkhead frame and interior structure.

8. The marine aft bulkhead and window system of claim 7 wherein the glass portion is bonded to two mullions that run vertically on each side of the glass portion.

9. The marine aft bulkhead and window system of claim 8 wherein the mullions are configured to move on travelers that are affixed left and right to a door frame.

10. The marine aft bulkhead and window system of claim 9 wherein the mullions further comprise a seal on their outer edge that engages a forward side of a glass portion of the port side glass assembly and a forward side of a glass portion of starboard side glass assembly when in a raised position.

* * * * *